US007329165B2

(12) United States Patent
Cranton et al.

(10) Patent No.: US 7,329,165 B2
(45) Date of Patent: Feb. 12, 2008

(54) METHOD OF PRODUCTION OF A THIN FILM ELECTROLUMINESCENT DEVICE AND DEVICES PRODUCED THEREBY

(75) Inventors: Mark Wayne Cranton, Nottingham (GB); Robert Stevens, Swindon (GB); Clive Thomas, Nottingham (GB); Emmanuel Antoine Mastio, Beinheim (FR); Hari Reehal, London (GB)

(73) Assignee: Nottingham Consultants Limited (GB)

( * ) Notice: Subject to any disclaimer, the term of this patent is extended or adjusted under 35 U.S.C. 154(b) by 899 days.

(21) Appl. No.: 10/182,990

(22) PCT Filed: Jan. 26, 2001

(86) PCT No.: PCT/GB01/00295

§ 371 (c)(1),
(2), (4) Date: Mar. 11, 2003

(87) PCT Pub. No.: WO01/58220

PCT Pub. Date: Aug. 9, 2001

(65) Prior Publication Data

US 2003/0190410 A1 Oct. 9, 2003

(30) Foreign Application Priority Data

Feb. 1, 2000 (GB) ..... 0002231.9

(51) Int. Cl.
*H01J 9/00* (2006.01)

(52) U.S. Cl. ..... 445/24

(58) Field of Classification Search ..... 427/554, 427/108, 157, 64, 557, 559, 66; 313/506, 313/509; 445/24; 252/301.4 R, 301.6 R, 252/301.6 S; 204/157.41, 157.4, 157.15
See application file for complete search history.

(56) References Cited

U.S. PATENT DOCUMENTS

| | | | | |
|---|---|---|---|---|
| 4,442,136 | A | 4/1984 | Johnson | 427/554 |
| 5,742,322 | A * | 4/1998 | Cranton et al. | 347/238 |
| 6,193,908 | B1 * | 2/2001 | Hampden-Smith et al. | 252/301.4 R |
| 6,241,911 | B1 * | 6/2001 | Potter | 252/301.4 R |
| 2002/0051894 | A1 * | 5/2002 | Yoshikawa | 428/690 |
| 2002/0130616 | A1 * | 9/2002 | Shirakawa et al. | 313/509 |

FOREIGN PATENT DOCUMENTS

WO PCT/GB01/00295 4/2001

OTHER PUBLICATIONS

Mastio, E.A., et al., "Pulsed laser annealing for high-efficiency thin film electroluminescent devices," *Journal of Applied Physics*, vol. 88, No. 3, pp. 1606-1611, (Aug. 1, 2000).

(Continued)

*Primary Examiner*—Joseph Williams
*Assistant Examiner*—Peter Macchiarolo
(74) *Attorney, Agent, or Firm*—Daniel B. Schein, Esq.

(57) ABSTRACT

A method of production of a thin film electroluminescent device comprising the steps of: providing a substrate; providing a conductor on the substrate; providing a dielectric layer on the conductor; providing a phosphor layer on the dielectric layer so creating a phosphor/dielectric interface region, the phosphor/dielectric region interface comprising a plurality of electron interface states; and transiently laser annealing the phosphor layer so as to induce an in depth annealing effect to the phosphor layer without heating the phosphor/dielectric region above a temperature which includes a substantial modification in the distribution of electron interface states.

17 Claims, 3 Drawing Sheets

OTHER PUBLICATIONS

Figure 1:
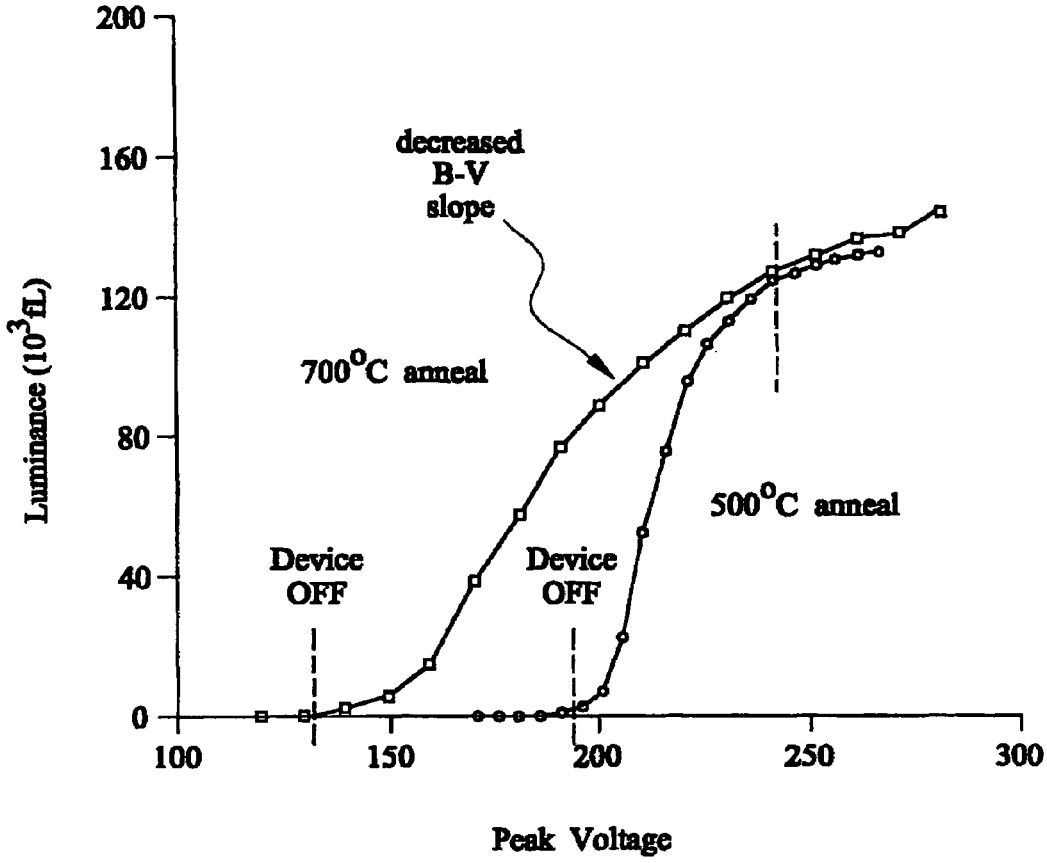

Mastio, E.A., et al., "Ablation study on pulsed KrF laser annealed electroluminescent ZnS:Mn/$Y_2O_3$ multilayers deposited on Si," *Applied Surface Science*, vol. 154-155, pp. 35-39, (2000).

Reehal, H.S., et al., "Pulsed XeCl laser annealing of ZnS:Mn thin films," *Appl. Phys. Lett.*, vol. 40, No. 3, pp. 258-260, (Feb. 1, 1982).

* cited by examiner

METHOD OF PRODUCTION OF A THIN FILM ELECTROLUMINESCENT DEVICE AND DEVICES PRODUCED THEREBY

The present invention relates to a method of production of a thin film electroluminescent device and also such devices.

The basic thin film electroluminescent structure (TFEL) consists of a phosphor thin film sandwiched between two insulating dielectric layers. In its simplest form, the full device is completed by the deposition of conductors on the outer surfaces of both dielectrics.

Light is produced by such devices by the application of a suitable AC drive voltage across the dielectrics. The electroluminescent characteristics and performance of the TFEL device are governed by three distinct mechanisms—firstly the field emission of the charged carriers from trapped electron interface states at the phosphor/dielectric interface, secondly the acceleration of the charge carriers under the electric field, and finally energy to transfer of the latter to luminescent centres followed by their radiative decay. Highly efficient TFEL devices are recognised by a sharp turn on slope and high brightness.

Critical to the performance of any TFEL device is the post deposition annealing treatment for the phosphor layer which facilitates the effective incorporation of the luminescent centres within the host lattice and improves its crystalline structure. It is known that such post deposition annealing at high temperatures can improve the luminosity of the resulting device.

Conventional thermal annealing techniques rely on processing times long enough to allow solid state defusion processes to occur. In one known technique the entire structure (i.e. the phosphor layer, the dielectric layers and the substrate) is heated. The annealing temperature is limited by either the melting temperature of the type of substrate used or by the induced modifications of the trapped electron interface states. For example, a typical TFEL device comprises of thin film of ZnS on a borosilicate glass. The ZnS has a melting temperature or 1830° C. but the annealing temperature is limited to around 500° C. as borosilicate glass softens around 570° C.

In the past, various approaches have been taken to treat the phosphor layer without damaging the commonly used glass substrate. One such process is disclosed in H S Reehal et al, Appl. Phys. Lett 40 (1982) 258, in which a nanosecond pulsed laser melting under high inert gas pressure diffuses and activates the pre-implanted Mn ions within the ZnS lattice. U.S. Pat. No. 4,442,136 discloses a similar method in which the ZnS lattice is melted under inert gas using a CW laser with high power density. Both of these approaches propose a substantial improvement in the TFEL device by generating a deep melt front within the ZnS lattice. However, whilst known annealing processes improve the brightness of the resulting devices they "soften" the brightness-voltage characteristics of these devices. This has the effect of broadening the voltage range over which the devices switch on. Electroluminescent devices which switch on over a narrow voltage range are preferred.

Accordingly, in the first aspect, the present invention provides a method of production of a thin film electroluminescent device comprising the steps of providing a substrate;

providing a conductor on the substrate;

providing a dielectric layer on the conductor;

providing a phosphor layer on the dielectric layer so creating a phosphor/dielectric interface region, the phosphor/dielectric interface region comprising a plurality of electron interface states; and, transiently laser annealing the phosphor layer so as to induce an in depth annealing effect in the phosphor layer without heating the phosphor/dielectric region above a temperature which induces a substantial modification in the distribution of the electron interface states.

The method according to the invention has the advantage that the resulting device has an improved luminosity without a softened brightness-voltage characteristic.

Preferably, the step of transiently laser annealing the phosphor layer produces a reduction in the slope of the brightness vs voltage characteristic of the resulting device of less than 10% as compared to an equivalent device annealed at 500 degrees Centigrade. This ensures that even after the annealing step the device can be switched on by a relatively narrow change in applied voltage.

The phosphor layer can comprise two or more allotropes of the phosphor; and the step of transiently laser annealing the phosphor layer induces a solid state phase transition between the allotropes of the phosphor layer.

Preferably the phosphor layer comprises ZnS. This has two stable allotropes (zinc blende and wurzite) which have a phase transition at around 1295 K which is well below the melting point of 2100 K.

Preferably the phosphor layer comprises one of SrS or $Y_2O_3$.

The phosphor layer can be doped with at least one of transition metal or rare earth luminescent centres, preferably at least one of Mn, Tb, Tm, TmF, Ce, Er, Eu or mixtures thereof.

The step of transiently laser annealing the phosphor layer can raise the temperature of at least a portion of the phosphor layer to at least 1295 kelvin, but does not raise the temperature of the interface region above 870 kelvin. This ensures that whilst the phosphor layer is raised to a temperature sufficient to cause annealing, the interface region is not raised above a temperature at which the distribution of interface states is substantially modified.

The transient laser annealing can be by pulse laser, preferably by excimer laser, more preferably one of a KrF, XeCl or XeF laser. Pulse duration can be between 0.1 ns and 500 ns.

The method of production of a thin film electroluminescent device according to the invention can further comprise the step or providing a gaseous medium in contact with the phosphor layer during the annealing, the pressure of the inert gas preferably being greater than 100 psi. This has the advantage that material dissociation at the surface of the device is reduced. Preferably the gas is inert, more preferably argon. The gas can be reactive, preferably Ar:$H_2S$.

Preferably the method can further comprise the seep of providing a buffer layer underlying at least one of the phosphor or dielectric layers. The buffer layer can be adapted to act as a heat sink. Preferably the buffer layer is a insulator or charge reservoir layer.

Figure 2:
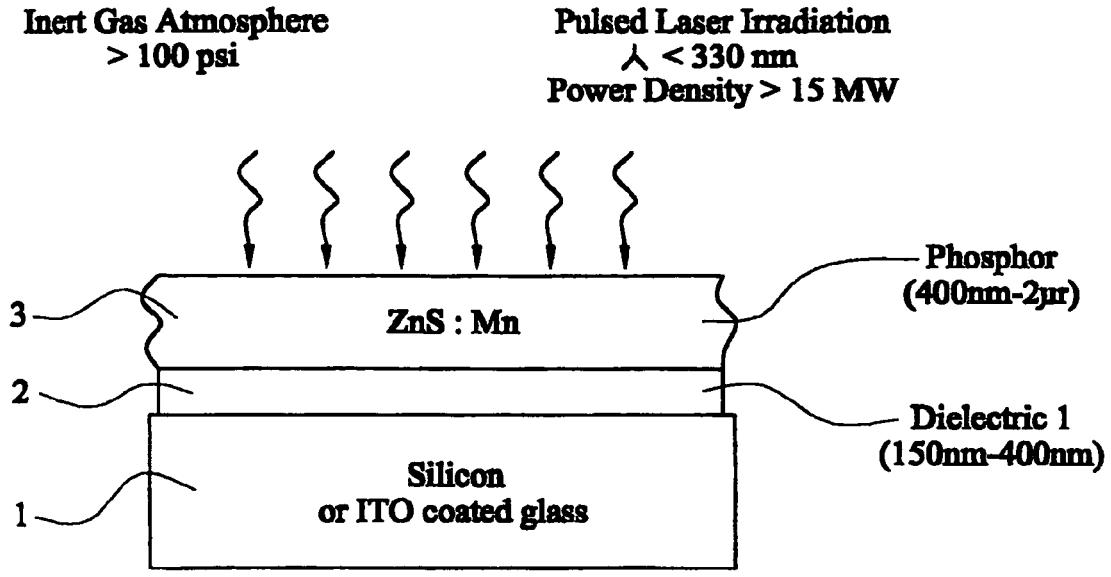
Figure 3:
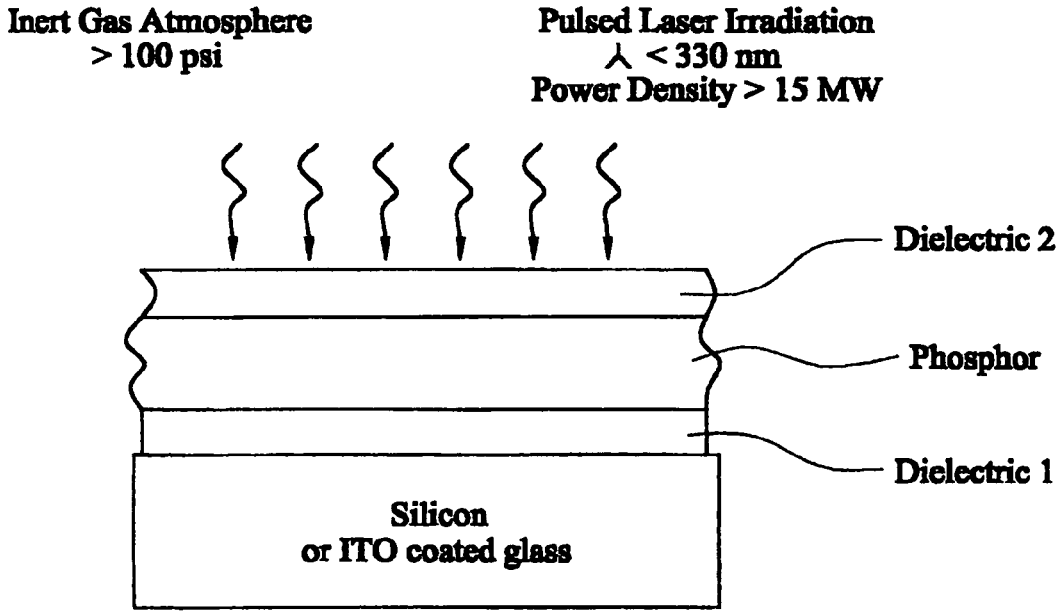
Figure 4:
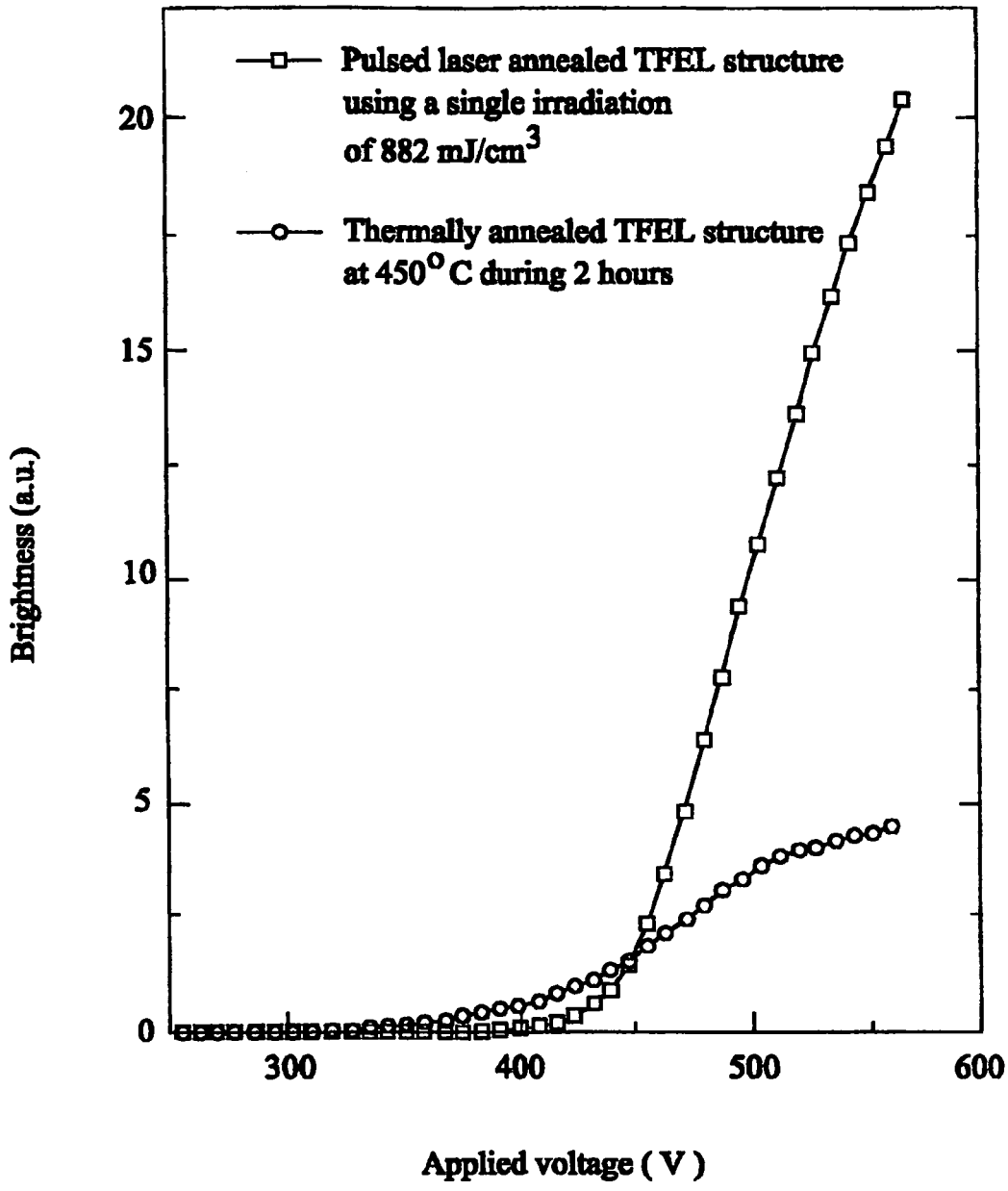

The present invention will now be described by way of example only, and not in any limitative sense, with reference to the accompanying drawings in which FIG. 1 shows the effect of a known annealing process on a thin film electroluminescent device;

FIGS. 2 and 3 show, in schematic form, laser annealing of a thin film electroluminescent device of a method according to the invention; and FIG. 4 shows the effect of the method of annealing according to the invention on a thin film electroluminescent device.

The present preferred embodiments of the invention are described here with references to the drawings, where like components are identified with the same references. The descriptions of the preferred embodiments are exemplary in nature and are not intended to limit the scope of the invention.

Shown in FIG. 1 is the effect of a known annealing process on a thin film electroluminescent device. The device comprises a substrate, conductor, a dielectric layer on the conductor and a phosphor layer disposed on the dielectric layer. The method of annealing comprises the step of heating the entire structure to a uniform temperature for a fixed hold time whilst annealing occurs in the phosphor layer. The structure is then cooled to room temperature. As can be seen from FIG. 1, increasing the annealing temperature has the effect of broadening the voltage range over which the resulting device switches on. This is because heating the phosphor and dielectric layers to such high temperatures alters the trapped electron states at the phosphor/dielectric layer interface. These trapped electrons states are important in determining the width of this voltage range. These trapped electron states are also important in determining the brightness of the resulting device. Such a known annealing method has the effect of substantially modifying the distribution of trapped electron interface states and hence the brightness of the resulting devices.

Shown in FIG. 2 is a cross sectional view of a portion of a thin film electroluminescent device. The device comprises substrate 1, a first dielectric layer 2 and a phosphor layer 3.

The substrate 1 comprises a silicon layer. The phosphor layer comprises ZnS is doped with Mn luminescent centres. The composition of the phosphor layer of this embodiment of the invention is ZnS:Mn (0.43 wt %) which is one of the most efficient TFEL phosphors. The ZnS:Mn layer is approximately 800 nm thick. The dielectric layer is comprised of $Y_2O_3$. This layer is approximately 300 nm thick.

In a method according to the invention, a KrF excimer laser with a wavelength of 249 nm is used to provide pulses of 20 ns duration with an energy density greater than 300 millijoules per centimeter squared (hence providing a delivered power density of >15 MW/cm$^2$). At this power density, the heat operated by the laser provides a surface temperature of >1295 kelvin in the phosphor layer but does not raise the dielectric phosphor interface to a temperature greater than 870 kelvin. This induces an in-depth annealing effect in the phosphor layer in the form of a measurable phase transition in the predominantly cubic ZnS to the hexagonal phase which is the stable allotrope at high temperatures. This results in an increase in the hexagonal crystallites and an increase in the luminescence both by photo luminescence and by electroluminescence excitation. The resultant TFEL device exhibits a four fold improvement in electroluminescent brightness as shown in FIG. 4. An important aspect of FIG. 4 is that the slope of the B-V characteristic remains sharp even after annealing. This can be contrasted with electroluminescent devices which have been annealed at temperatures in excess of 500 degrees Celsius by known annealing methods in which the B-V slope is reduced.

The method is applicable to all phosphor thin films requiring annealing for activation where it is critical that in depth melting or high temperature effects at the phosphor dielectric interface are minimised. The technique requires the use of a pulse laser radiating of a wave length suitable to provide high surface absorption in the phosphor thin film. Depending on the available beam area cross section the laser pulse can be applied to individual emitting areas via scanning. Alternatively, for larger beams the laser pulse can be applied to the entire substrate provided that the power density is above the transition threshold for the particular phosphor used (e.g. >15 mw/cm$^2$ for ZnS:Mn).

It is advantageous to perform the laser irradiation in a high pressure gas atmosphere (preferably >100 psi) to reduce dissociation effects eg ablation. The gas can be inert (preferably argon) or can contain reactive elements to enhance annealing such as $H_2S$, or $S_2$.

In a further embodiment of the invention (not shown) the electroluminescent device includes a buffer layer. This buffer layer underlies the phosphor layer (or possibly the dielectric layer). In use this buffer layer acts as a heat sink. Examples of suitable buffer layers include insulators or charge reservoirs such as ITO, $SiO_3$ and $Y_2\ O_3$.

In an alternate embodiment of the invention the substrate is of a size suitable for use in large area displays, typically greater than 100 mm.

In alternative embodiments of the invention the phosphor layer is doped with luminescent centres comprising transition metals or rare earths. Examples include TmF, Ce, Er, Eu or mixtures thereof.

In an alternative embodiment the phosphor layer comprises at least one of SrS, $Y_2O_3$, YAG and ZnO.

In an alternate embodiment the dielectric layer can further include $BaTiO_3$, SiON, $S_{13}N_4$, $SiO_3$ and suitable combinations thereof.

In an alternate embodiment the pulse laser is an excimer laser, preferably one of Xef, XeCl and KrF.

In an alternate embodiment single or multiple irradiations can be used per single target area.

Shown in table 1 are results of x-ray characteristics determined for samples annealed by a known thermal method and also for samples laser annealed by a method according to the invention. The studied structure was a multilayer of ZnS:Mn (800 nm)/$Y_2O_3$ (300 nm) deposited on Si. $I_{111,ZnS}$ and $I_{222,\ Y203}$ are the integrated intensities of the diffraction lines corresponding to the cubic forms of ZnS:Mn (111) and $Y_2O_3$ (222) lines, respectively.

$I_{00.2,ZnS}$ is the integrated intensity of the ZnS (00.2) diffraction line belonging to the hexagonal wurzite form of ZnS. The hexagonal structure of ZnS only appears with laser processing suggesting that temperatures within the phosphor layer are higher than the transition temperature, i.e., around 1295 K. However, as evidence by the diffraction intensity of the insulator layer ($I_{222}$, $Y_2O_3$), the temperature attained at the interface is <600° C. A study of the full width at half maximum of the diffraction peaks, dependent on grain size, does not show significant changes implying that no substantial grain growth occurs. In turn, although surface melting might occur using laser power densities up to 48 MW/cm$^2$, the melting region remains at the surface of the phosphor layer.

It is intended that the foregoing detailed description be regarded as illustrative rather than limiting and that it be understood that it is the following claims, including all equivalents, which are intended to define the scope of the invention.

| | Thermal annealing temp. (° C.) | | | $P_d$(MW/cm$^2$) | |
|---|---|---|---|---|---|
| | 200 | 500 | 600 | 6 | 48 |
| $I_{222,Y2O3}$ (a.u.) | 599 ± 2 | 1642 ± 17 | 4320 ± 36 | 1903 ± 80 | 2394 ± 89 |
| $I_{111,ZnS}$ (a.u.) | 20 ± 4 | 54 ± 4 | 648 ± 13 | 1114 ± 45 | — |
| $I_{00.2,ZnS}$ (a.u.) | — | — | — | — | 1383 ± 50 |

The invention claimed is:

1. A method of production of a thin film electroluminescent device comprising the steps of:

providing a substrate;

providing a conductor on the substrate;

providing a dielectric layer on the conductor;

providing a phosphor layer on the dielectric layer so creating a phosphor/dielectric interface region, the phosphor/dielectric region interface comprising a plurality of electron interface states; and transiently laser annealing the phosphor layer so as to induce an in depth annealing effect in the phosphor layer without heating the phosphor/dielectric region above a temperature which induces a substantial modification in the distribution of electron interface states.

2. A method of production of a thin film electroluminescent device as claimed in claim 1, wherein the step of transiently laser annealing the phosphor layer produces a reduction in the slope of the brightness versus voltage characteristic of the resulting device of less than 10% compared to an equivalent device annealed to 500 degrees Celcius.

3. A method of production of a thin film electroluminescent device as claimed in claim 1, wherein the phosphor layer comprises two or more allotropes of the phosphor; and the step of transiently laser annealing the phosphor layer induces a solid state phase transition between the allotropes of the phosphor layer.

4. A method of production of a thin film electroluminescent device as claimed in claim 3, wherein the phosphor layer comprises ZnS.

5. A method of production of a thin film electroluminescent device as claimed in claim 1, wherein the phosphor layer comprises at least one of the group consisting of SrS, $Y_2O_3$, YAG, and ZnO.

6. A method of production of a thin film electroluminescent device as claimed in claim 1, wherein the phosphor layer is doped with at least one transition metal luminescent center.

7. A method of production of a thin film electroluminescent device as claimed in claim 1, wherein the step of transiently laser annealing the phosphor layer raises the temperature of at least a portion of the phosphor layer to at least 1295 kelvin, but does not raise the temperature of the interface region above 870 kelvin.

8. A method of production of a thin film electroluminescent device as claimed in claim 1, wherein the transient laser annealing step is performed by a pulse laser, the pulse duration being between 0.1 ns and 500 ns.

9. The method of claim 8, wherein said pulse laser comprises an excimer laser.

10. The method of claim 8, wherein said pulse laser is selected from the group consisting of a KrF laser, a XeCl laser, and a XeF laser.

11. A method of production of a thin film electroluminescent device as claimed in claim 1, further comprising the step of providing a gaseous medium in contact with the phosphor layer during the annealing step, wherein the pressure of the gaseous medium is greater than 100 psi.

12. A method of production of a thin film electroluminescent device as claimed in claim 1, further comprising the step of providing a buffer layer underlying at least one of the phosphor or dielectric layers, the buffer layer being adapted to act as a heat sink.

13. A method of production of a thin film electroluminescent device as claimed in claim 12, wherein the buffer layer is an Insulator or charge reservoir layer.

14. The method of claim 1, wherein the phosphor layer is doped with at least one rare earth luminescent center.

15. The method of claim 1, wherein the phosphor layer is doped with at least one luminescent center selected from the group consisting of Mn, Tm, TmF, Ce, Er, and Eu.

16. An electroluminescent device produced by the process of claim 1.

17. The device of claim 16, wherein said process further comprises the step of transiently laser annealing the phosphor layer produces a reduction in the slope of the brightness versus voltage characteristic of the resulting device of less than 10% compared to an equivalent device annealed to 500 degrees Celsius.

* * * * *